US006976683B2

(12) United States Patent
Eckert et al.

(10) Patent No.: US 6,976,683 B2
(45) Date of Patent: Dec. 20, 2005

(54) CYLINDER HEAD GASKET

(75) Inventors: Dieter Eckert, Plochingen (DE); Thomas Friedow, Plymouth, MI (US)

(73) Assignee: Elring Klinger AG, Dettingen (DE)

( * ) Notice: Subject to any disclaimer, the term of this patent is extended or adjusted under 35 U.S.C. 154(b) by 0 days.

(21) Appl. No.: 10/647,363

(22) Filed: Aug. 25, 2003

(65) Prior Publication Data

US 2005/0046119 A1 Mar. 3, 2005

(51) Int. Cl.[7] ..... F02F 11/00
(52) U.S. Cl. ..... 277/591; 277/597; 277/599
(58) Field of Search ..... 277/591–597, 277/599

(56) References Cited

U.S. PATENT DOCUMENTS 1,982,759 A * 12/1934 Rosen ..... 277/597
3,765,385 A 10/1973 Conrad ..... 123/41
5,000,464 A 3/1991 Yasui ..... 031/277
5,601,294 A * 2/1997 Stritzke ..... 277/597
6,406,032 B1 * 6/2002 Miyaoh ..... 277/594

FOREIGN PATENT DOCUMENTS

DE 3543641 12/1985
EP 0863603 B1 8/2002

* cited by examiner

*Primary Examiner*—Enoch E. Peavey

(57) ABSTRACT

A cylinder head gasket comprising a gasket plate for an engine in which at least one first coolant cavity is formed in the engine block adjacent to the cylinder head gasket, with the gasket plate comprising coolant passage openings via which the first coolant cavity is connectable to at least one second coolant cavity formed in the cylinder head of the engine; for improved cooling of the engine the cylinder head gasket comprises at least one flow conducting element for the coolant protruding from the gasket plate, the at least one flow conducting element being of such configuration and being joined to a coolant passage opening of the gasket plate in such a way that the flow conducting element forms a flow path with the coolant passage opening and is designed so as to engage in at least one of the first and second coolant cavities and to generate a directed flow of coolant at the outlet end of the flow path.

12 Claims, 5 Drawing Sheets

CYLINDER HEAD GASKET

BACKGROUND OF THE INVENTION

The invention relates to a cylinder head gasket, and, in particular, to an at least substantially metallic cylinder head gasket, for influencing the flow of coolant within a reciprocating internal combustion engine comprising several combustion chambers arranged one after another (this can be a so-called in-line engine, or equally well a so-called V-engine or any other engine having several so-called cylinder banks).

A conventional flow of coolant through such an engine will first be explained with reference to an in-line engine, however, the same applies accordingly to other engines with several cylinder banks. The coolant is mostly introduced into the engine block (often also referred to as cylinder block or crankcase) at a narrow or end face of the engine by the coolant pump of the engine such that the direction of the flow of coolant at the point of introduction is oriented in the longitudinal direction of the engine, i.e., in the direction of the row of cylinders. The coolant then essentially flows past the row of cylinders into the area of the other narrow or end face of the engine. In this area, the cylinder head gasket clamped between engine block and cylinder head has coolant passage openings through which the coolant is conducted into the cylinder head—since the coolant pump of the engine is arranged upstream of the engine block a higher coolant pressure prevails in the coolant cavities of the engine block than in the cylinder head. The coolant is conducted away at the cylinder head, namely in the area of that end face of the engine at which the flow of coolant is introduced into the engine block. When the cylinder head, which in a plan view corresponds approximately to a narrow rectangle, is considered, the intake ports are located at one longitudinal side thereof, and the exhaust ports at the other opposite longitudinal side thereof. In order to achieve better and more uniform cooling, above all, of the cylinder head, cylinder head gaskets have also been used, which comprise coolant passage openings not only in the area of one end face of the engine but also in the areas of the two longitudinal sides of the engine, with the coolant passage openings neighboring on the exhaust gas side of the cylinder head being larger than the coolant passage openings of the cylinder head gasket neighboring on the intake side of the cylinder head in order that the exhaust gas side of the cylinder head will be cooled better. In any case, such a flow of coolant prevails in the engine that in the vicinity of the cylinder head gasket both in the engine block and in the cylinder head a main flow component of the flow of coolant runs approximately parallel to the plane defined by the cylinder head gasket or its gasket plate (either in longitudinal direction of the engine or approximately diagonally from an edge of one narrow side to the diagonally opposite edge of the other narrow side, and the latter in the case where the cylinder head gasket has larger coolant passage openings on the exhaust gas side than on the intake side).

The flow conditions explained hereinabove result in zones in the cylinder head of known engines which are insufficiently cooled by the coolant. The inventors have found that this is also due to the following circumstance: In the hitherto conventional cylinder head gaskets the coolant passage openings thereof have been in the form of simple holes; furthermore, the gasket plates of the cylinder head gaskets are relatively thin, above all, since in many cases single-layered or multilayered metallic gaskets have replaced the old, somewhat thicker so-called soft-material gaskets (at least in substantially metallic cylinder head gaskets the thickness of the gasket plate is between 0.25 and 2.0 mm). Therefore, those partial flows of the coolant which flow through the coolant passage openings of the gasket plate from the engine block into the cylinder head do not form any distinctively oriented coolant flows of considerable kinetic energy, with the result that in the coolant cavity or coolant cavities of the cylinder head the flow of coolant predominantly directed approximately parallel to the cylinder head gasket above the coolant passage openings of the gasket cannot be deflected to any great extent by these partial flows of coolant. In order to avoid local overheating in the cylinder head caused by dead zones in the flow of coolant, particularly sophisticated configurations of the cylinder head in terms of casting technology have therefore hitherto proven necessary.

The object underlying the invention is to create a cylinder head gasket with which the problems explained hereinabove can at least be mitigated, if not completely eliminated.

SUMMARY OF THE INVENTION

The invention proceeds from a cylinder head gasket comprising a gasket plate for an engine in which at least one first coolant cavity with coolant flowing therethrough is formed in the engine block adjacent to the cylinder head gasket, at least one flow conducting element for the coolant being provided on the cylinder head gasket so as to protrude from the gasket plate of the cylinder head gasket, and the gasket plate comprising coolant passage openings via which the at least one first coolant cavity is connectable to at least one second coolant cavity formed in the cylinder head of the engine.

In accordance with the invention, such a cylinder head gasket is designed such that the at least one flow conducting element is of such configuration and is joined to a coolant passage opening in such a way that the flow conducting element forms a flow path with the coolant passage opening and is designed so as to engage in at least one of the first and second coolant cavities and to generate a directed flow of coolant at the outlet end of the flow path which preferably faces the cylinder head.

Thus, in accordance with the invention, a simple hole in the known cylinder head gaskets is replaced by such a combination of passage opening and flow conducting element that there can be generated with it in the cylinder head (or, as the case may be, in the engine block) a directed jet of coolant which contains significantly more kinetic energy than a flow of coolant as generated by a simple passage opening of a conventional cylinder head gasket. As will be apparent from the following, the invention makes it possible to exploit the kinetic energy of the flow of coolant present in the engine block in the vicinity of the cylinder head gasket and/or to use a flow conducting element designed like a nozzle to generate partial flows of coolant entering the cylinder head with a considerable kinetic energy, so that the flow of coolant prevailing in the cylinder head in the vicinity of the cylinder head gasket can be considerably deflected and/or swirled in the desired way (in order to thereby eliminate dead zones in the flow of coolant) or even selected locations of the cylinder head can be acted upon with directed partial flows of coolant.

When evaluating the above definition of the invention and the appended claims it has to be borne in mind that each cylinder head gasket is constructed for a certain type of engine, i.e., the engine construction is already available to the developer of the gasket. It is therefore admissible to refer to features of the engine block and/or the cylinder head when defining the invention relating to a cylinder head gasket.

EP-0 868 603-B1 discloses a multilayered metallic cylinder head gasket for an in-line engine, which is provided with flow conducting elements for the coolant which protrude approximately vertically from the gasket plate and engage in coolant cavities which are formed in the engine block and through which the coolant flows. However, these flow conducting elements serve exclusively (nor are they capable of anything else) to deflect the flow of coolant within these coolant cavities formed in the engine block and to direct the flow of coolant to selected locations of the engine block. Alternatively, the same measure is proposed for the coolant cavities formed in the cylinder head (see column 6, lines 43–46 of EP-0 868 603-B1). It must, however, be pointed out that EP-0 868 603-B1 points away from the present invention as the flow conducting elements are to be arranged at locations on the cylinder head gasket at which the coolant does not pass into the cylinder head (see column 6, lines 13–16 of EP-0 868 603-B1, i.e., the openings shown, for example, in FIG. 5 of this publication are to lie at places where there is no coolant cavity located on the engine block side and/or the cylinder head side of the cylinder head gasket). Aside from that, EP-0 868 603-B1 consistently discloses coolant passage openings of the cylinder head gasket only in one narrow side end area of the gasket plate (see the coolant passage openings 8 in FIGS. 2 to 4*b* and 6).

The cylinder head gasket according to the invention is particularly suitable for engines in which coolant flows through the at least one first coolant cavity (in the engine block) such that at least in an area of this coolant cavity a main flow component of the flow of coolant runs approximately parallel to the gasket plate, as, in addition to the pressure difference between the two sides of the cylinder head gasket, the kinetic energy of this main flow component can then also be used in order to achieve an effective directed jet of coolant by the flow conducting element being designed so as to engage in the first coolant cavity and to form, when the cylinder head gasket is installed, such an impingement and deflector surface for the main flow component that a flow of coolant directed transversely to the gasket plate enters the coolant passage opening associated with the flow conducting element.

As mentioned hereinabove, a directed jet of coolant with a relatively high flow velocity can also be generated in accordance with the invention by a kind of nozzle. In this case, the configuration of a cylinder head gasket according to the invention is such that the flow conducting element is designed so as to engage in the second coolant cavity (in the cylinder head) and is provided at the outlet end (on the cylinder head side) of the flow path with a nozzle for generating a directed jet of coolant in the second coolant cavity.

Further features, details and advantages of the invention will be apparent from the appended claims and/or the following description as well as the attached drawings of several particularly advantageous embodiments of the cylinder head gasket according to the invention.

DETAILED DESCRIPTION OF THE INVENTION

Figure 1:
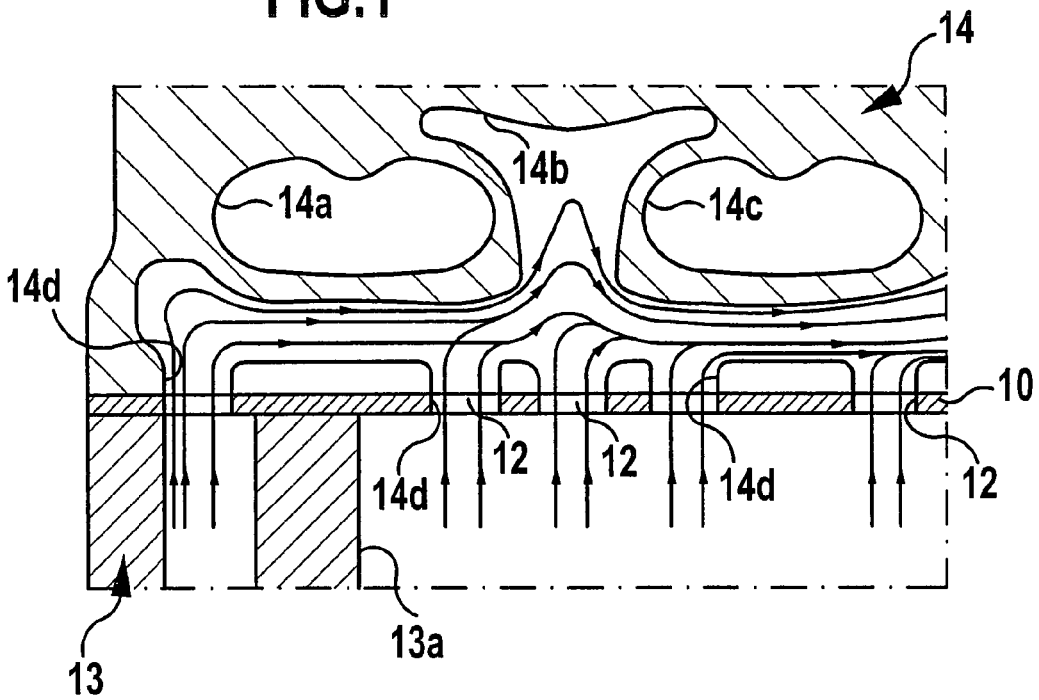
FIG. 1 shows a schematic section through parts of a cylinder head and an engine block and through part of a conventional cylinder head gasket with a simple hole as coolant passage opening including the coolant flow relationships below and above the cylinder head gasket.

FIG. 1 shows schematically part of a gasket plate 10 of a conventional cylinder head gasket in which coolant passage openings 12 are provided in the form of simple holes. The engine block is designated 13, the cylinder head 14. In the illustrated case, and in the embodiments explained hereinbelow, too, the coolant pressure below the cylinder head gasket (i.e., in this case in the engine block) is intended to be greater than above the cylinder head gasket.

FIG. 1 shows the case described hereinabove in which a main flow component of the flow of coolant runs approximately parallel to the plane defined by the gasket or its gasket plate on either of the two sides of the cylinder head gasket. In FIG. 1 all flows of coolant are indicated by flow lines and arrows, and, as will be apparent from FIG. 1, owing to the pressure gradient mentioned hereinabove, partial flows of the flow of coolant existing below the gasket plate 10 flow upwards through the passage openings 12 of the gasket plate and in the area above the passage openings 12 each result in an albeit relatively small deflection of the flow of coolant existing above the gasket plate 10 upwards. As will be apparent from FIG. 1, such a relatively small deflection may, however, be totally insufficient.

Figure 2:
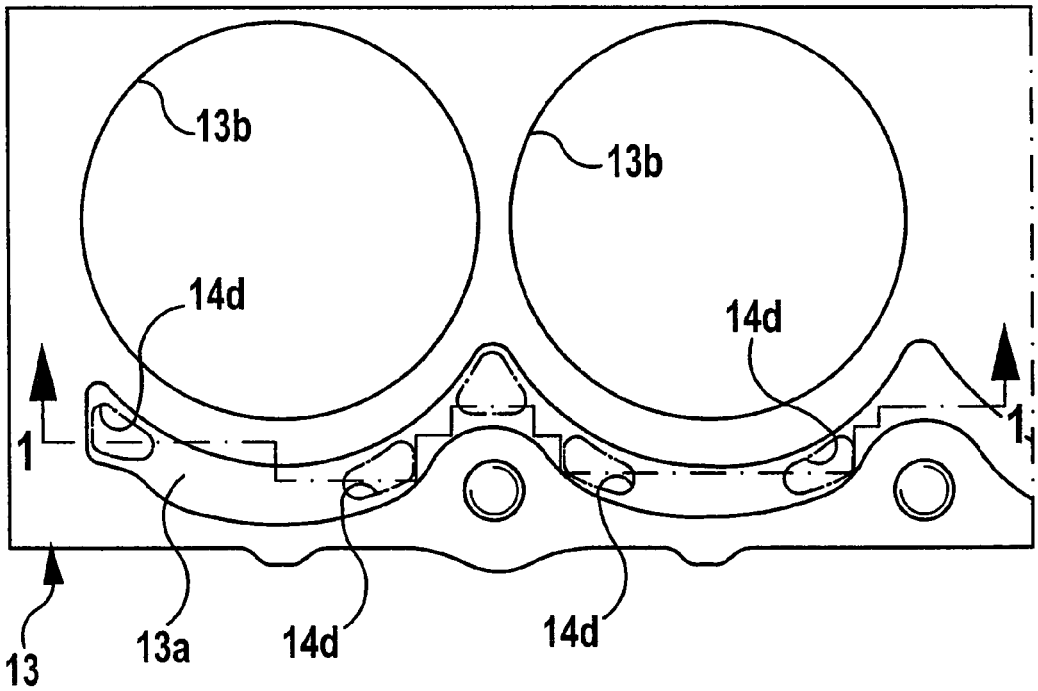
FIG. 2 shows a plan view of the engine block shown in FIG. 1 with an illustration of how the section shown in FIG. 1 is taken on line 1—1.

In FIGS. 1 and 2, a coolant cavity (so-called water jacket) in the engine block 13 is designated 13*a*, and coolant cavities shown in FIG. 1 are designated 14*a*, 14*b* and 14*c*. FIG. 1 also shows so-called coolant passages 14*d* whose position in FIG. 2 is indicated in dot-and-dash lines. Two combustion chambers shown in FIG. 2 are designated 13*b*.

As shown in FIG. 1, the cooling of the cylinder head 14 in the area of the coolant cavity 14*b* is quite incomplete in spite of the deflection of the flow of coolant above the coolant passage openings 12, as coolant only flows through this coolant cavity in the bottom area thereof, over which a dead zone with coolant not flowing or at least almost not flowing through it has formed, and which is consequently badly cooled.

Figure 3:
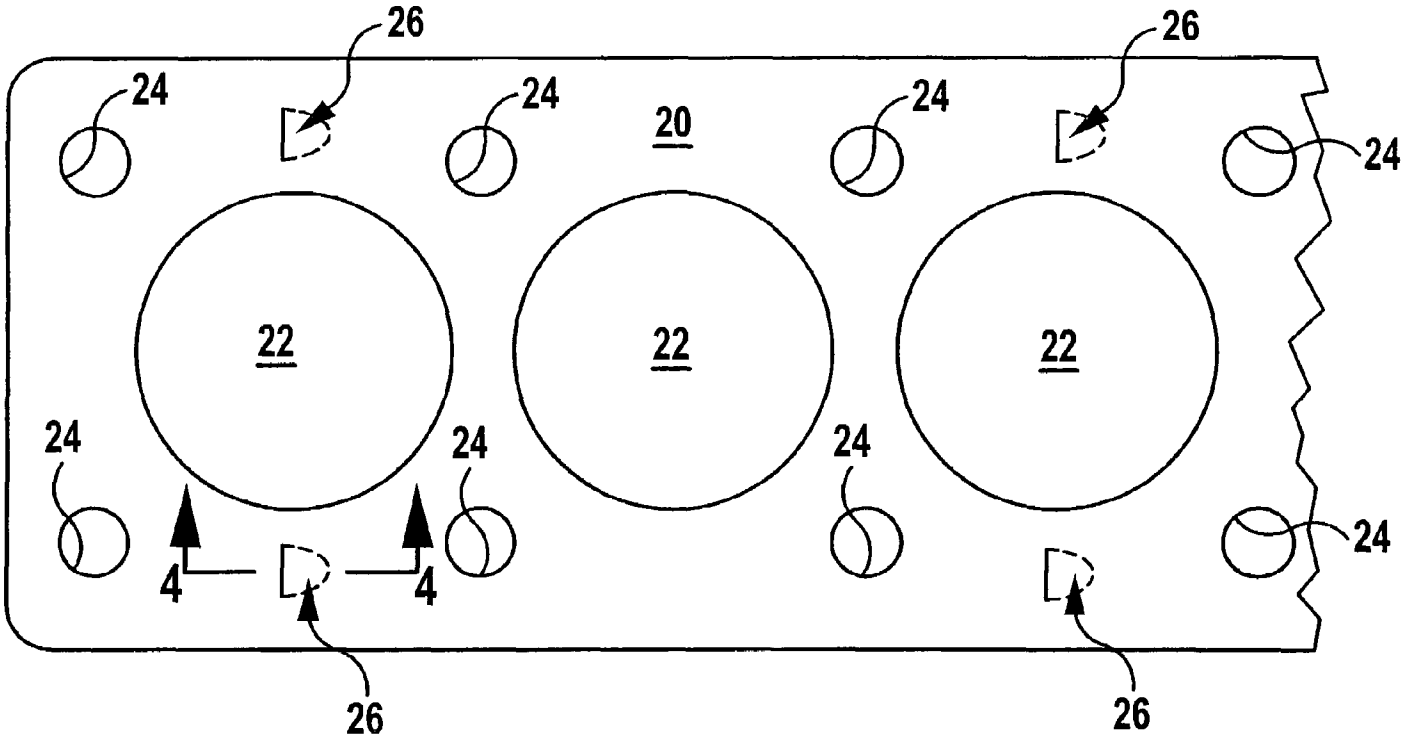
FIG. 3 shows a schematic plan view of part of a first embodiment of the inventive cylinder head gasket.
Figure 4:
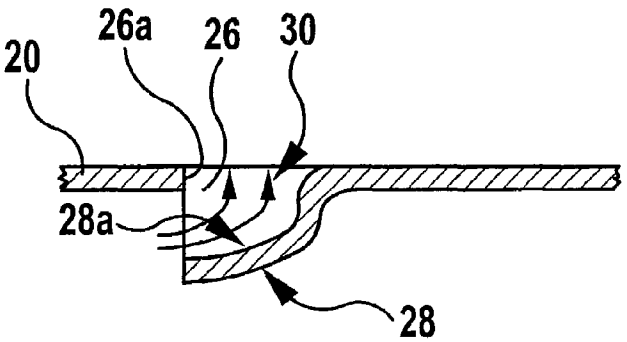
FIG. 4 shows an illustration of the first embodiment of the inventive cylinder head gasket corresponding to part of FIG. 1, but without engine block and cylinder head.

With reference to FIGS. 3 and 4, a first embodiment of the invention will be explained in detail hereinbelow.

FIG. 3 shows in a plan view part of a cylinder head gasket according to the invention with a gasket plate 20 in which several combustion chamber openings 22, several screw openings 24 for cylinder head screws and also several coolant passage openings 26 are formed. FIG. 4 shows a section taken on line 4—4 in FIG. 3 and hence a section through one of these coolant passage openings 26 with an adjacent flow conducting element according to the invention.

FIG. 4 shows a single-layered gasket plate 20 out of which a pocket-shaped or scoop-shaped flow conducting element 28 has been shaped by being punched and bent outwards, thereby forming the coolant passage opening 26, with the pocket or scoop formed by the flow conducting element being open in the direction opposite to its inflow direction. The flow conducting element could, of course, also be only a sheet metal tongue which has been severed at its free end and at its two sides from the sheet metal layer forming the gasket plate 20 by punching, but continues at its root into the sheet metal layer forming the gasket plate. FIG. 4 is, however, as mentioned hereinabove, intended to show a pocket-shaped or scoop-shaped flow conducting element which has been manufactured by an, in particular straight, cutting line 26A (extending at right angles to the drawing plane of FIG. 4) being produced in the sheet metal layer forming the gasket plate 20 by means of punching, and by an area of the sheet metal to the right of this cutting line in accordance with FIG. 4 then being bent out downwards like a pocket so that this area continues overall into the sheet metal layer forming the gasket plate 20, only not at the location of the cutting line 26A. As this flow conducting element 28 forms an impingement and deflector surface 28*a* for the flow of coolant directed from the left to the right in accordance with FIG. 4, with such a flow conducting element not only the pressure difference between the two sides of the cylinder head gasket but also the kinetic energy of the flow of coolant existing below the cylinder head gasket results in the formation of a directed jet of coolant 30, which is oriented transversely to the plane of the gasket plate 20 and exits from the coolant passage opening 26 upwards into the cylinder head, thereby causing a swirl in the flow of coolant there, which prevents formation of dead zones in an area of a coolant cavity located above the coolant passage opening 26.

Figure 5:
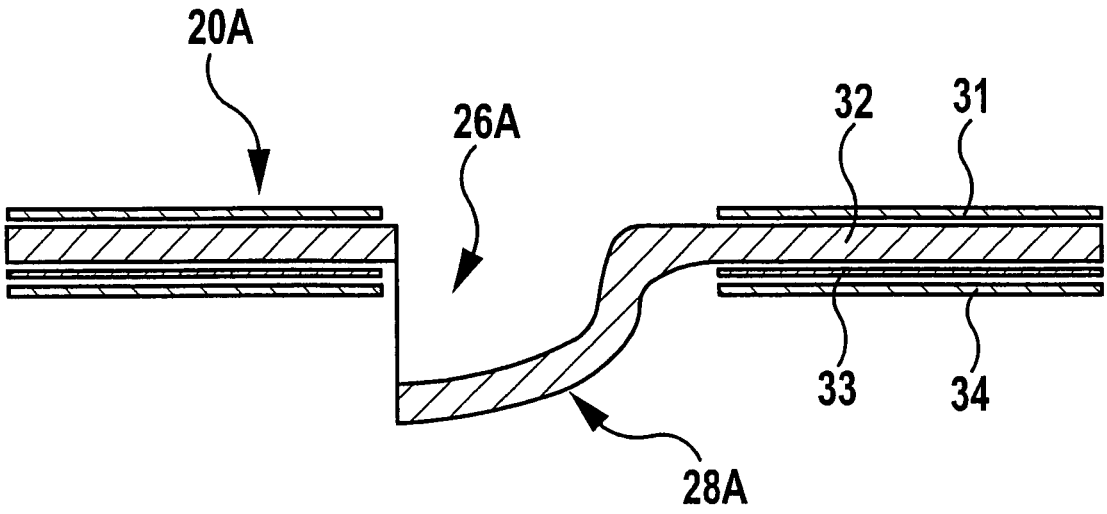
FIG. 5 shows a sectional illustration through a second embodiment of the inventive cylinder head gasket similar to that of FIG. 4, but with a multilayered gasket plate construction.

FIG. 5 shows the part of an inventive cylinder head gasket shown in FIG. 4, but with the difference that in accordance with FIG. 5 the gasket plate 20A consists of several sheet metal layers, in particular, of two layers of sheet spring steel 31 and 34, which may, for example, be 0.2 mm thick, a sheet metal layer 32 made of low-alloy steel with a thickness of, for example, 0.3 to 2 mm, and a layer of sheet stainless steel 33 with a thickness of, for example, 0.12 mm.

As the sheet metal layer 32 consisting of low-alloy steel can be shaped relatively well in contrast to the other three layers, a flow conducting element 28A has been shaped from the sheet metal layer 32, namely in the same way as in the embodiment according to FIG. 4, whereas only window-like openings have been punched out of the other three sheet metal layers 31, 33 and 34 so as to produce a coolant passage opening 26A in the gasket plate 20A.

Figure 6:
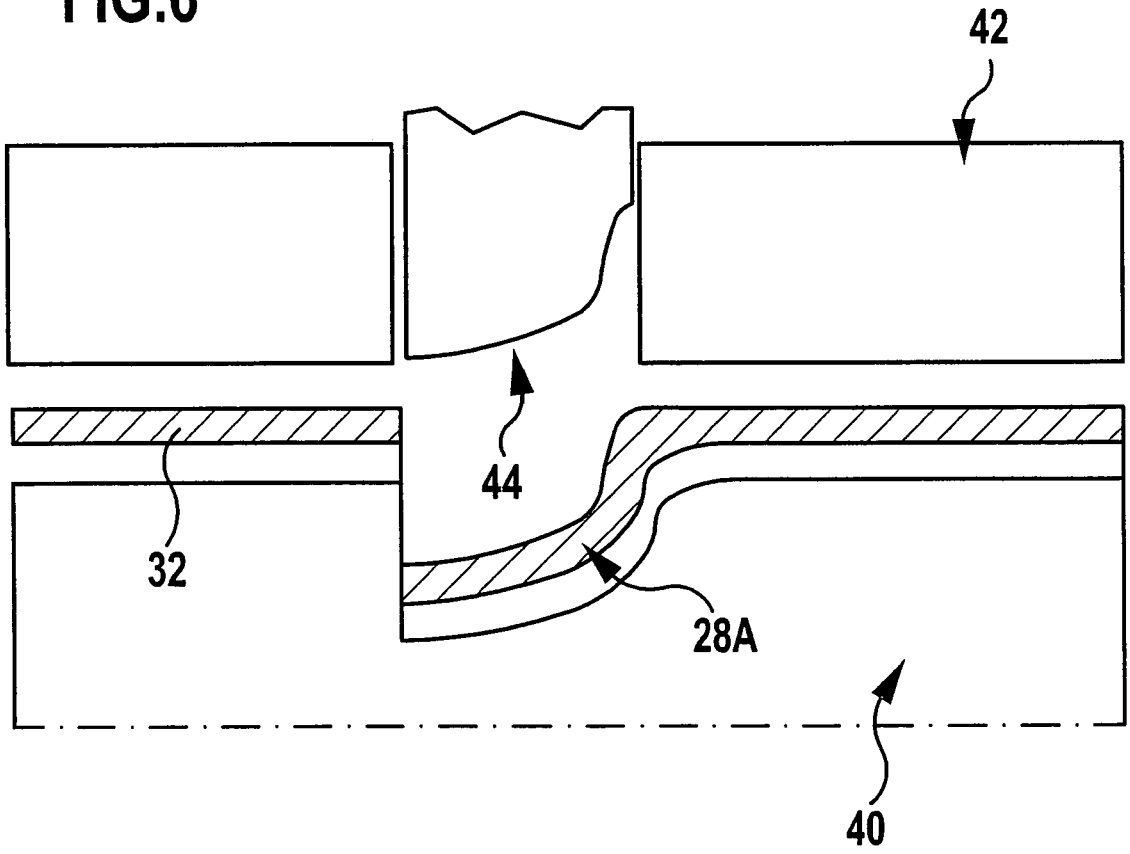
FIG. 6 shows a tool for manufacturing the flow conducting element according to the invention in a sheet metal layer of the second embodiment shown in FIG. 5.

FIG. 6 shows schematically a punching and bending tool for producing the flow conducting element 28A in the sheet metal layer 32. This tool has a die 40, on which the sheet metal layer 32 is placed, a holding-down device 42 with which the sheet metal layer 32 is pressed onto the die 40, and a punch 44 for punching and deep drawing, with which the pocket-shaped or scoop-shaped flow conducting element 28A is punched and bent outwards.

Figure 7:
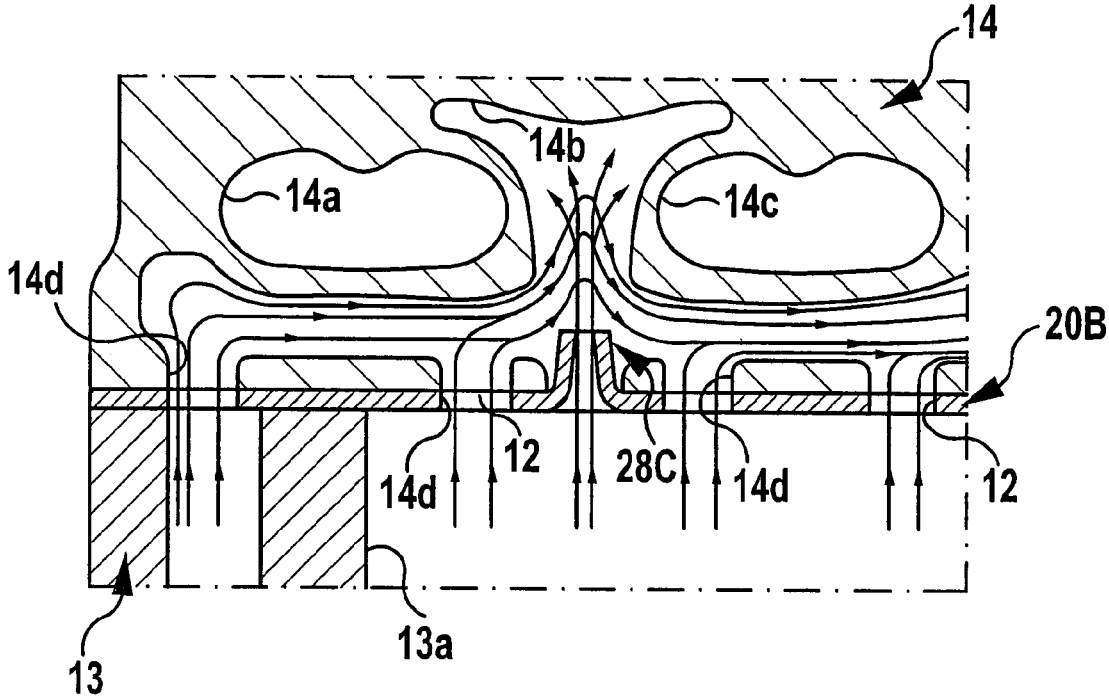
FIG. 7 shows a third embodiment of the invention in a sectional illustration corresponding to FIG. 1.

FIG. 7 shows in a section corresponding to FIG. 1 part of a gasket plate 20B, out of which a nozzle-like flow conducting element 28B has been shaped by a punching and deep drawing tool which is not shown. However, the gasket plate 20B could also be multilayered and have, for example, the same structure as gasket plate 20A in accordance with FIG. 5, i.e., comprise four sheet metal layers 31, 32, 33 and 34, and, the flow conducting element 28B, which extends upwards through an opening in the sheet metal layer 31 and below which passage openings are provided in the layers 33 and 34, could, for example, be shaped from the sheet metal layer 32. Aside from that, the same reference numerals have been used in FIG. 7 as in FIG. 1. As a result of the flow conducting element 28B, dead zones cannot form in the coolant cavity 14*b*.

Figure 8:
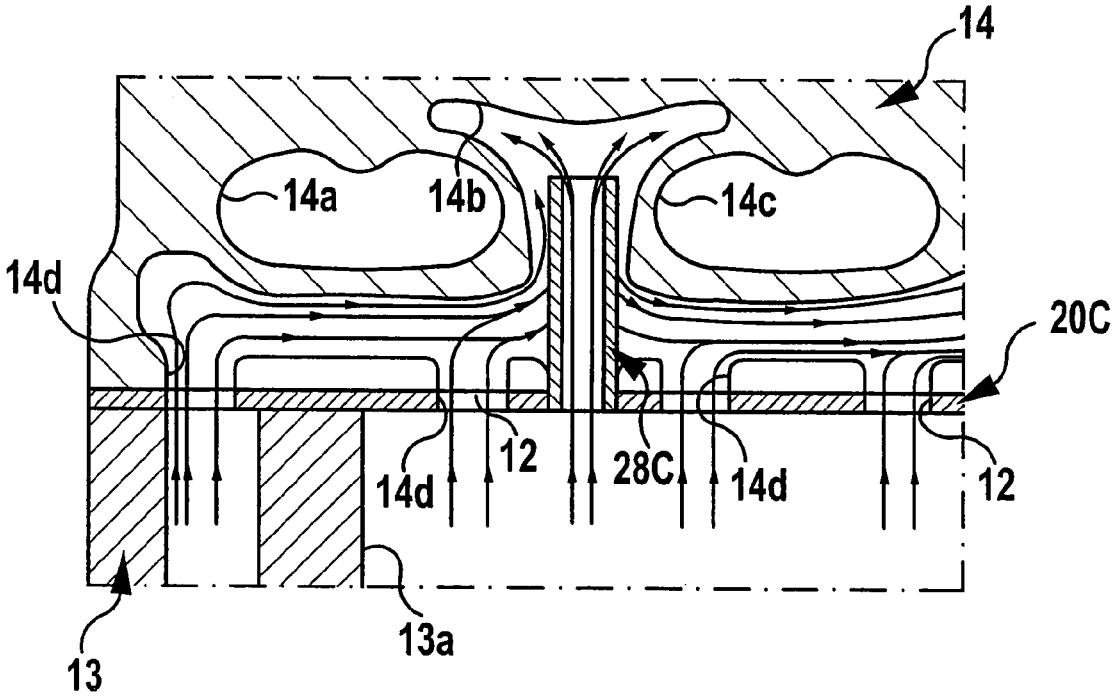
FIG. 8 shows an illustration of a fourth embodiment of the invention corresponding to FIG. 7.

FIG. 8 shows a flow conducting element 28C inserted into a single-layer gasket plate 20C in an illustration corresponding to that of FIG. 7. In this embodiment the flow conducting element 28C is inserted in a hole in the gasket plate and attached there, for example, by welding. The flow conducting element 28C projects in accordance with the invention far into a coolant cavity, for example, cavity 14*b*, of the cylinder head, so that a directed jet of coolant flows into this coolant cavity in a particularly effective way. The tube-shaped flow conducting element could also be bent and/or provided with a nozzle-like outlet end portion in the area of its free end.

It is also pointed out that a flow conducting element according to the invention extending away from one side of the cylinder head gasket can be combined with a flow conducting element according to the invention extending away from the other side of the gasket, for example, flow conducting element 28 according to FIG. 4 with flow conducting element 28C according to FIG. 8.

FIG. 9 again shows part of a multilayered gasket plate 20E with a coolant passage opening 26E. There is attached to one side of the gasket plate 20E a flow conducting element 28E which is a separately manufactured part in the shape of a curved tube with an attachment flange.

Figure 9:
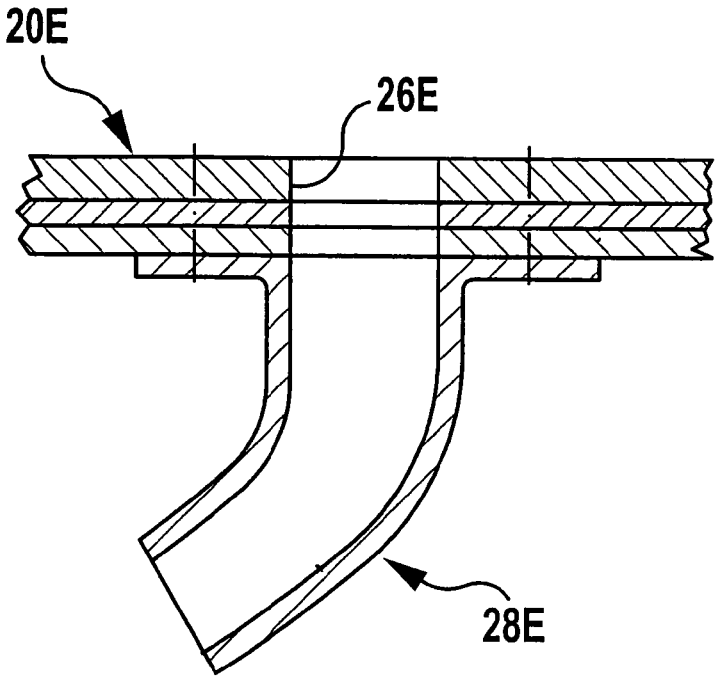
FIG. 9 shows a sectional illustration of part of a fifth embodiment of the inventive cylinder head gasket.
Figure 10:
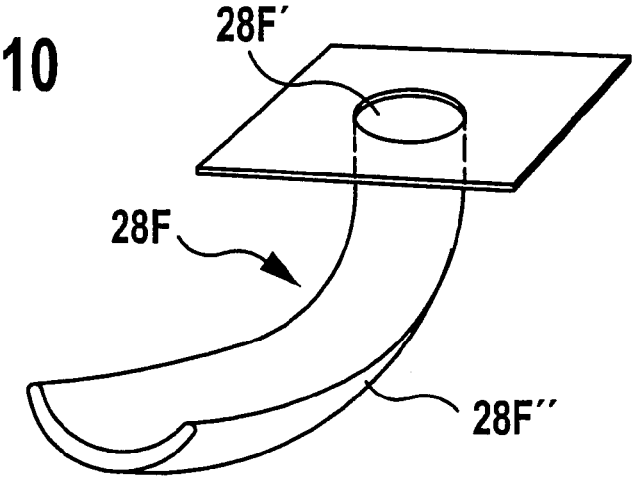
FIG. 10 shows a schematic, perspective illustration of a sixth embodiment of a flow conducting element according to the invention.

FIG. 10 shows a similar flow conducting element 28F in which a curved guide vane 28F", which takes the place of the tube shown in FIG. 9, extends away from a hole 28F' of an attachment flange.

Figure 11:
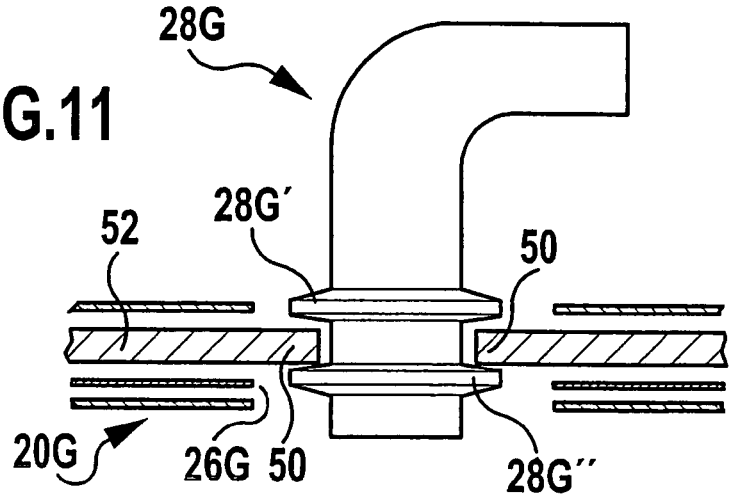
FIG. 11 shows a sectional illustration of a seventh embodiment of the invention corresponding to FIG. 10.

FIG. 11 shows a flow conducting element similar to that of FIG. 8, namely a flow conducting element 28G, which has been manufactured as a separate part and is in the form of an angled, approximately L-shaped tube. On the outer circumference of this tube there are two ring-shaped shoulders 28G' and 28G", which form a ring-shaped groove and serve to attach the flow conducting element to a multilayered gasket plate 20G. This gasket plate has an opening 26G, in which snap-in projections 50 of a sheet metal layer 52 of the gasket plate 20G are located, which can snap into the ring-shaped groove mentioned hereinabove in order to hold the flow conducting element 28G on the gasket plate.

Flow conducting elements made of a suitable, sufficiently heat-resistant and, in particular, elastomeric plastic material, which are easier to produce than metal parts with a relationship of diameter to length of the flow conducting element which is favorable for the directed flow of coolant aimed at, are particularly advantageous. Such plastic parts can be made to snap into or can be directly attached by vulcanization to an opening in the metallic gasket plate or a sheet metal layer thereof.

As will be apparent from the foregoing, an element which has a directional effect on a partial flow of the coolant flowing from one gasket side to the other, which is significantly larger than that of a simple hole insofar as the latter has a directional effect at all, is provided in accordance with the invention on a cylinder head gasket.

In modern reciprocating internal combustion engines very small amounts of coolant are circulated so as to bring the engine up to operating temperature as rapidly as possible when cold starting. Also, when cold starting, relatively small flow velocities are aimed at, and, in this case, the directed flow of coolant to critical locations proves particularly advantageous.

The invention is particularly well suited for so-called open-deck engines where the coolant cavities extend into the immediate vicinity of the cylinder head gasket, as flow conducting elements which protrude to a relatively slight extent from the gasket plate of the cylinder head gasket are then already adequate. In the case of closed-deck engines, there borders on the cylinder head gasket, at least on the engine block side, a plate of the engine block which forms a sealing surface and contains in this sealing surface coolant openings through which the flow conducting elements according to the invention should extend.

Of course, the basic concept underlying the invention can also be applied to cylinder head gaskets for engines in which the coolant flows into the cylinder head gasket from the cylinder head side and exits from it at the engine block side of the gasket. In this case, the two gasket sides have simply to be interchanged in the above explanations.

If the kinetic energy of the flow of coolant is to be exploited, it is recommended that the depth to which the flow conducting element engages in the flow of coolant be chosen so as to exceed, preferably by a multiple, the thickness of the gasket plate.

If flow conducting elements are produced as separate parts, it is recommended that these be in the form of injection molded plastic parts.

What is claimed is:

1. A cylinder head gasket for an engine having an engine component in the form of an engine block and another engine component in the form of a cylinder head with at least one coolant cavity formed in said engine block adjacent to said cylinder head and at least one coolant cavity formed in said cylinder head adjacent to said engine block to provide a flow of coolant through at least a first one of said coolant cavities in a first one of said engine components such that at least in an area of this first coolant cavity a main flow component of said flow of coolant runs approximately parallel to a gasket plate of the cylinder head gasket when it is installed on the engine, said cylinder head gasket having at least one flow conducting element for the coolant so as to protrude from the gasket plate at a location thereof to engage in said first coolant cavity when the cylinder head gasket is installed, said gasket plate comprising at least one coolant passage opening for communicating said first coolant cavity with a coolant cavity formed in a second one of said engine components when the cylinder head gasket is installed, wherein said at least one flow conducting element is joined to said at least one coolant passage opening to provide a flow path comprising said at least one flow conducting element and said coolant passage opening and having an inlet end defined by said flow conducting element as well as an outlet end, said at least one flow conducting element providing an impingement and deflector surface for said main flow component disposed between said inlet end and said at least one coolant passage opening such that, when the cylinder head gasket is installed, part of said main flow component is deflected to provide a flow of coolant entering said coolant passage opening in a direction generally transverse to the gasket plate and generating a directed flow of coolant at the outlet end of the flow path.

2. Cylinder head gasket in accordance with claim 1, wherein the at least one flow conducting element is designed so as to engage in the at least one second coolant cavity and is provided at the outlet end of the flow path with a nozzle for generating a directed jet of coolant in the second coolant cavity.

3. Cylinder head gasket in accordance with claim 2, wherein the gasket plate comprises at least one sheet metal layer out of which the edge area of the coolant passage opening is bent and thereby forms at least one of a tube-shaped flow conducting element or a nozzle-shaped flow conducting element.

4. Cylinder head gasket in accordance with claim 3, wherein the gasket plate is multilayered and comprises a sheet metal layer consisting of low-alloy steel, and the flow conducting element is formed by a shaped area of this low-alloy steel sheet metal layer.

5. Cylinder head gasket in accordance with claim 1, wherein at least in an inflow area the at least one flow conducting element is designed like a guide vane.

6. Cylinder head gasket in accordance with claim 5, wherein the gasket plate comprises at least one sheet metal layer out of which a guide vane-like section is bent in the area of at least one coolant passage opening.

7. Cylinder head gasket in accordance with claim 6, wherein the gasket plate is multilayered and comprises a sheet metal layer consisting of low-alloy steel, and the flow conducting element is formed by a shaped area of this low-alloy steel sheet metal layer.

8. Cylinder head gasket in accordance with claim 6, wherein the guide vane-like section forms on the gasket plate a pocket or scoop opening in a direction approximately parallel to the plane of the gasket plate and continuing integrally at its sides and at its base into the sheet metal layer.

9. Cylinder head gasket in accordance with claim 8, wherein the gasket plate is multilayered and comprises a sheet metal layer consisting of low-alloy steel, and the flow conducting element is formed by a shaped area of this low-alloy steel sheet metal layer.

10. Cylinder head gasket in accordance with claim 1, wherein at least in an inflow area the at least one flow conducting element has a tube shape.

11. Cylinder head gasket in accordance with claim 10, wherein the gasket plate comprises at least one sheet metal layer out of which the edge area of the coolant passage opening is bent and thereby forms at least one of a tube-shaped flow conducting element or a nozzle-shaped flow conducting element.

12. Cylinder head gasket in accordance with claim 1, wherein the at least one flow conducting element is manufactured as a separate part and is attached to the gasket plate.

* * * * *